US009306347B2

(12) United States Patent
Ma et al.

(10) Patent No.: US 9,306,347 B2
(45) Date of Patent: Apr. 5, 2016

(54) ELECTRICAL CONNECTOR HAVING IMPROVED INSULATIVE HOUSING

(71) Applicant: HON HAI PRECISION INDUSTRY CO., LTD., New Taipei (TW)

(72) Inventors: Hao-Yun Ma, San Jose, CA (US); Chih-Pi Cheng, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 87 days.

(21) Appl. No.: 14/190,118

(22) Filed: Feb. 26, 2014

(65) Prior Publication Data

US 2015/0244098 A1 Aug. 27, 2015

(51) Int. Cl.

| | |
|---|---|
| ***H01R 13/41*** | (2006.01) |
| ***H01R 24/60*** | (2011.01) |
| *H01R 13/50* | (2006.01) |
| *H01R 12/57* | (2011.01) |

(52) U.S. Cl.

CPC ..... *H01R 24/60* (2013.01); *H01R 13/41* (2013.01); *H01R 12/57* (2013.01); *H01R 13/50* (2013.01)

(58) Field of Classification Search

CPC ..... H01R 23/02; H01R 13/26; H01R 12/724

USPC ..... 439/660, 607.4

See application file for complete search history.

(56) References Cited

U.S. PATENT DOCUMENTS

| | | | | |
|---|---|---|---|---|
| 7,824,220 | B2 * | 11/2010 | Chen | 439/607.35 |
| 2012/0045935 | A1 * | 2/2012 | Zhang et al. | 439/607.08 |

FOREIGN PATENT DOCUMENTS

| | | |
|---|---|---|
| CN | 101599607 B | 6/2011 |

* cited by examiner

*Primary Examiner* — Tulsidas C Patel
*Assistant Examiner* — Marcus Harcum
(74) *Attorney, Agent, or Firm* — Wei Te Chung; Ming Chieh Chang

(57) ABSTRACT

An electrical connector includes an insulative housing having a mating tongue, a plurality of first contacts retained in the housing and exposed upon a first mating face of the mating tongue, and a plurality of second contacts retained in the housing and exposed upon a second mating face of the mating tongue. The first contacts offset with the second contacts in a front elevational view. The mating tongue defines a receiving room at a front portion thereof and extending in a transverse direction, the receiving room runs through the first mating face to directly face to the first contacts and synchronously runs through the second mating face to directly face to the second contacts, which is suitable for minimization.

13 Claims, 6 Drawing Sheets

ELECTRICAL CONNECTOR HAVING IMPROVED INSULATIVE HOUSING

BACKGROUND OF THE INVENTION

1. Field of the Invention

The present invention relates to an electrical connector, and more particular to an electrical connector having an improved insulative housing which provides a center receiving room in a mating tongue to suit for miniaturization.

2. Description of the Related Art

Chinese Pat. No. 101599607 issued on Jun. 29, 2011 discloses an electrical connector including an insulative housing, a plurality of contacts retained to the housing, and a shielding shell enclosing the housing. The housing defines a forwardly extending mating tongue thereof, and the plurality of contacts are divided into upper and lower contacts respectively exposed upon opposite mating faces of the mating tongue. However, the mating tongue provides a barrier disposed between the upper and lower contacts for insulating the upper and lower contacts, which expenses a lot of room and is not benefit for miniaturization.

Therefore, a new design is required.

SUMMARY OF THE INVENTION

Accordingly, an object of the present invention is to provide an electrical connector having an improved insulative housing suitable for miniaturization.

In order to achieve the object set forth, an electrical connector includes an insulative housing having a mating tongue extending in a front-to-back direction, and a plurality of first and second contacts retained in the housing. The mating tongue defines opposite first and second mating faces stacked in a vertical direction perpendicular to the front-to-back direction. The first contacts are arranged in a transverse direction perpendicular to both the front-to-back direction and the vertical direction and each defines a resilient first contacting portion exposed on the first mating face and a first soldering portion extending out of the housing. The second contacts are arranged in the transverse direction and each defines a resilient second contacting portion exposed on the second mating face and a second soldering portion extending out of the housing, the first contacting portions offset with the second contacting portions in a front elevational view. The mating tongue defines a receiving room at a front portion thereof and extending in the transverse direction, the receiving room runs through the first mating face to directly face to the first contacting portions and synchronously runs through the second mating face to directly face to the second contacting portions.

Other objects, advantages and novel features of the invention will become more apparent from the following detailed description of the present embodiment when taken in conjunction with the accompanying drawings.

DETAILED DESCRIPTION OF THE INVENTION

Figure 1:
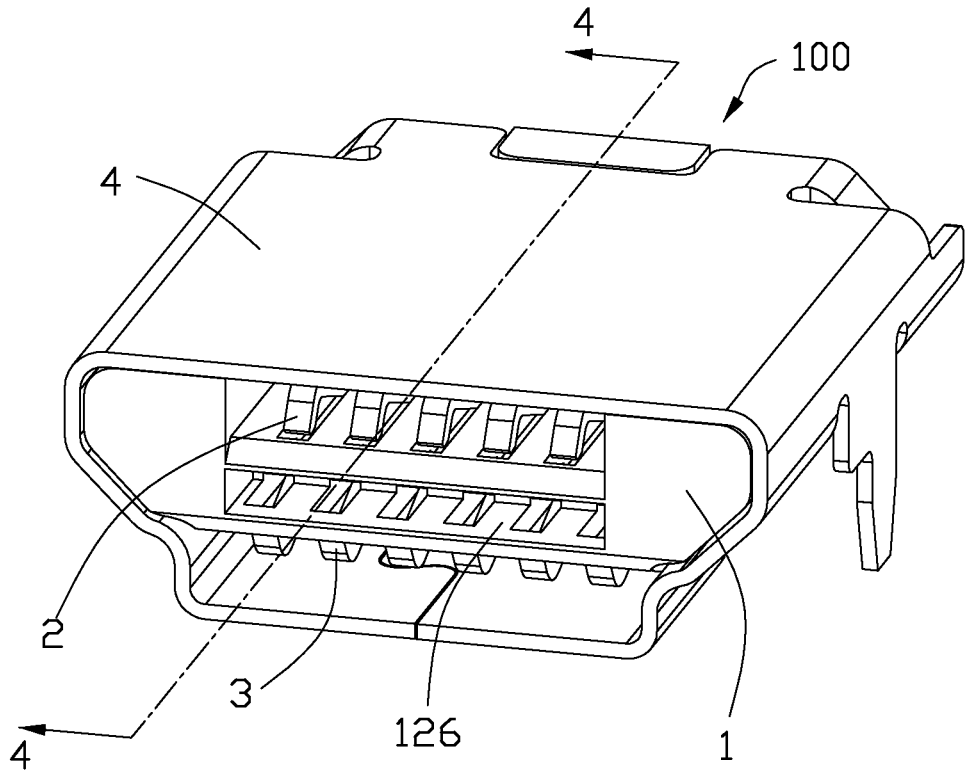
FIG. 1 is a perspective view of an electrical connector in accordance with the present invention.

Reference will now be made to the drawing figures to describe a preferred embodiment of the present invention in detail. Referring to FIG. 1, the electrical connector 100 includes an insulative housing 1, a plurality of first and second contacts 2, 3 retained in the housing 1, and a metal shell 4 enclosing the housing 1.

Figure 2:
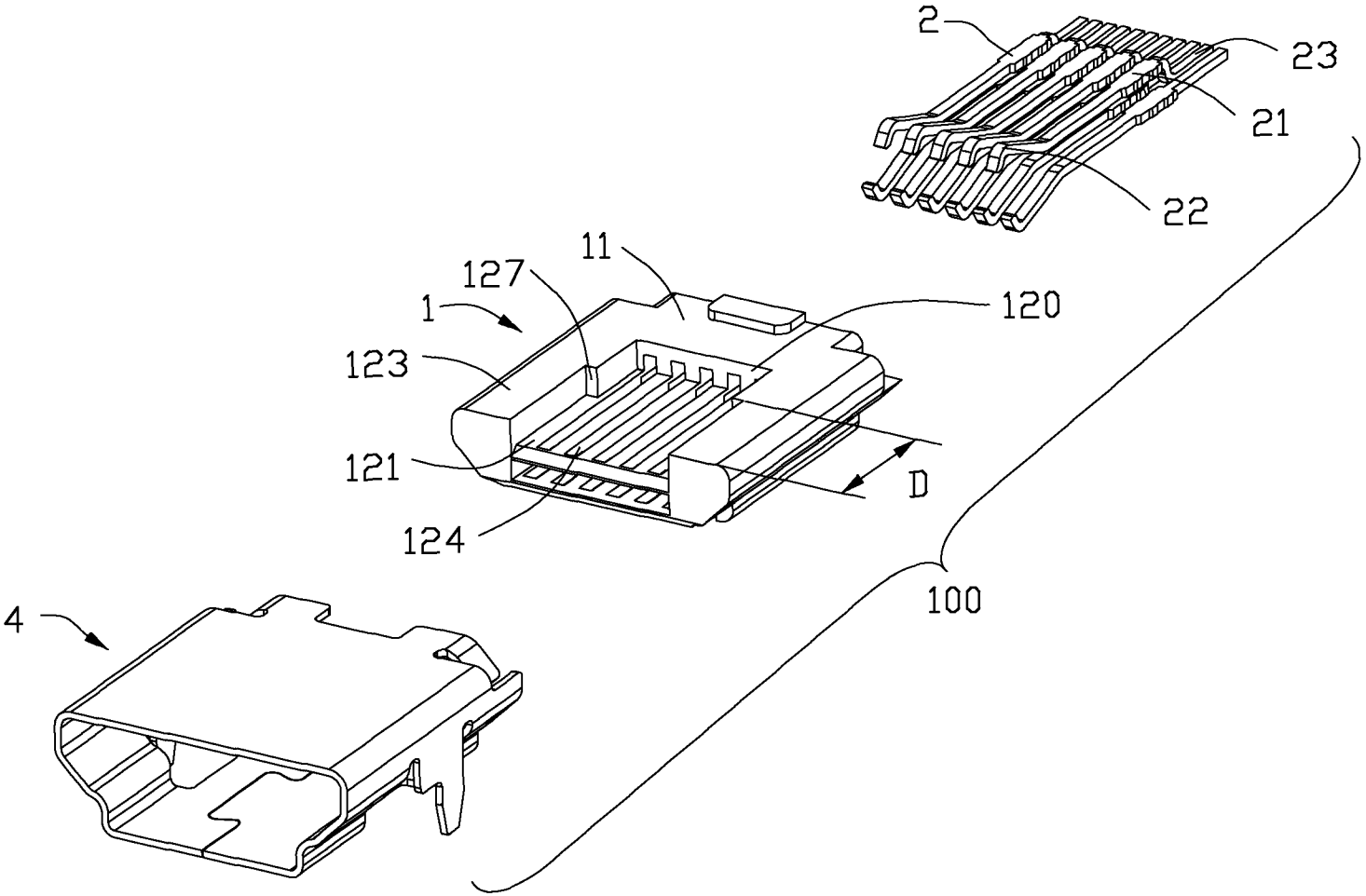
FIG. 2 is an exploded perspective view of the electrical connector shown in FIG. 1.
Figure 3:
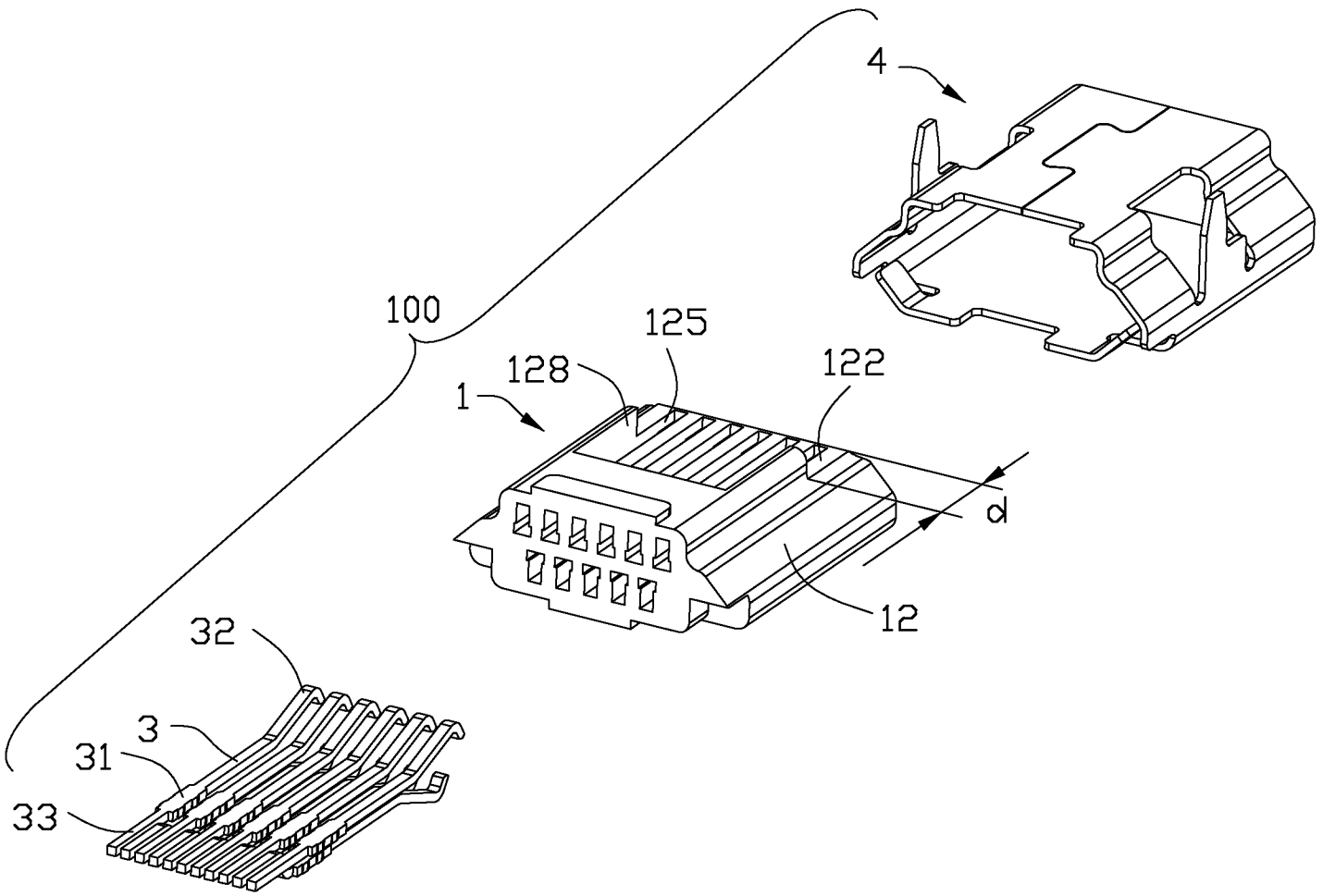
FIG. 3 is another exploded perspective view of the electrical connector shown in FIG. 3.
Figure 4:
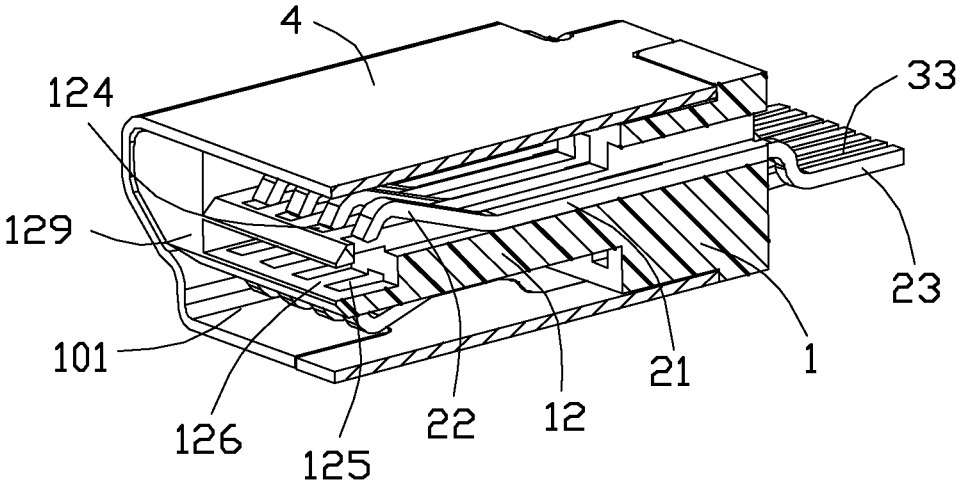
FIG. 4 is a cross-sectional view of FIG. 1 taken along line 4-4, showing the configuration of the receiving room.
Figure 5:
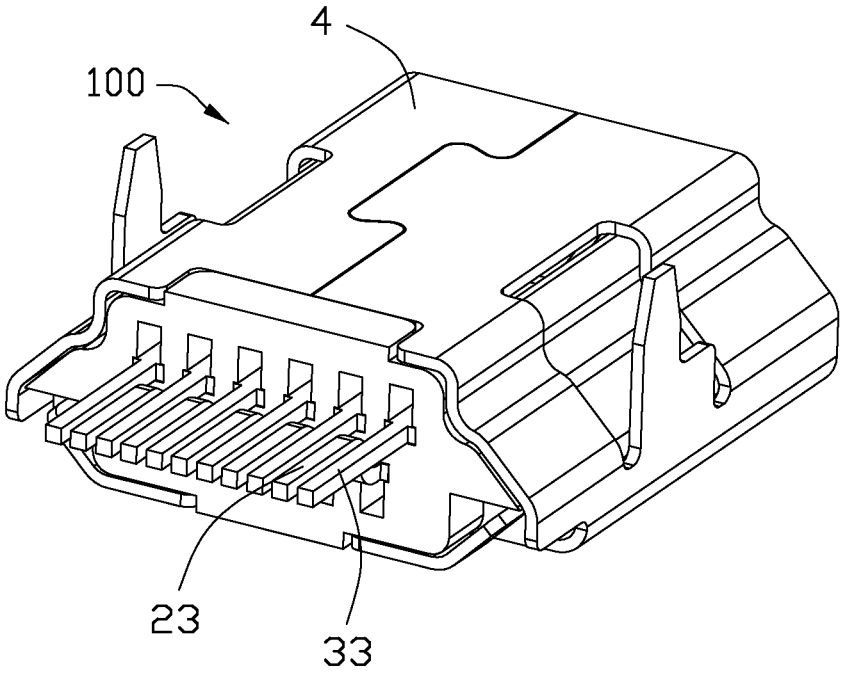
FIG. 5 is another perspective view of the electrical connector shown in FIG. 1.

Referring to FIG. 2 to FIG. 4, the housing 1 includes a rear base 11 and a U-shaped front mating tongue 12 forwardly extending from the rear base 11 along a front-to-back direction. The mating tongue 12 defines opposite first and second mating faces 121, 122 stacked in a vertical direction perpendicular to the front-to-back direction and a pair of strengthen arms 123 disposed at two transverse ends thereof. An upper face disposed in a recess portion 120 of the mating tongue 12 is defined as the first mating face 121, and a bottom face of the mating tongue 12 is defined as the second mating face 122. A plurality of first and second terminal receiving grooves 124, 125 forwardly run through the rear base 11 and extend in the mating tongue 12 to respectively impenetrate the first and second mating faces 121, 122. The mating tongue 12 defines a receiving room 126 at a front portion thereof to communicate with the first and second terminal receiving grooves 124, 125. The receiving room 126 extends along the transverse direction and further runs through a front face 129 of the mating tongue 12.

Each strengthen arm 123 defines a first blocking portion 127 disposed in the recess portion 120 and a second blocking portion 128 projecting from the bottom face. A first insertion depth D is provided between the first blocking portion 127 and the front face 129 of the mating tongue 12, and a second insertion depth d is provided between the second blocking portion 128 and the front face 129 of the mating tongue 12, the first insertion depth D and the second insertion depth d are different from each other for cooperating with corresponding mating connectors respectively.

Referring to FIG. 2 to FIG. 5, the plurality of first contacts 2 are arranged along the transverse direction and each defines a first retaining portion 21 with barbs protruding on both sides thereof, a resilient first contacting portion 22 extending from the first retaining portion 21 and upwardly bending at a front end, and a first soldering portion 23 bending downwardly and extending rearwards from the first retaining portion 21. The plurality of second contacts 3 are arranged along the transverse direction and each defines a second retaining portion 31 with barbs protruding on both sides thereof, a resilient second contacting portion 32 extending from the second retaining portion 31 and downwardly bending at a front end, and a second soldering portion 33 extending rearwards from the second retaining portion 31.

The plurality of first contacts 2 are forwardly assembled and retained to the plurality of first terminal receiving grooves 124, and the plurality of second contacts 3 are forwardly assembled and retained to the plurality of second terminal receiving grooves 125. The resilient first contacting portions 22 project to expose upon the first mating face 121, and the resilient second contacting portion 32 project to expose upon the second mating face 122. The first and second soldering portions 23, 33 extend out of the housing 1 to be alternately arranged in one row. The metal shell 4 is rearwards assembled to the housing 1 and encloses the mating tongue 12 in a mating cavity 101.

Figure 6:
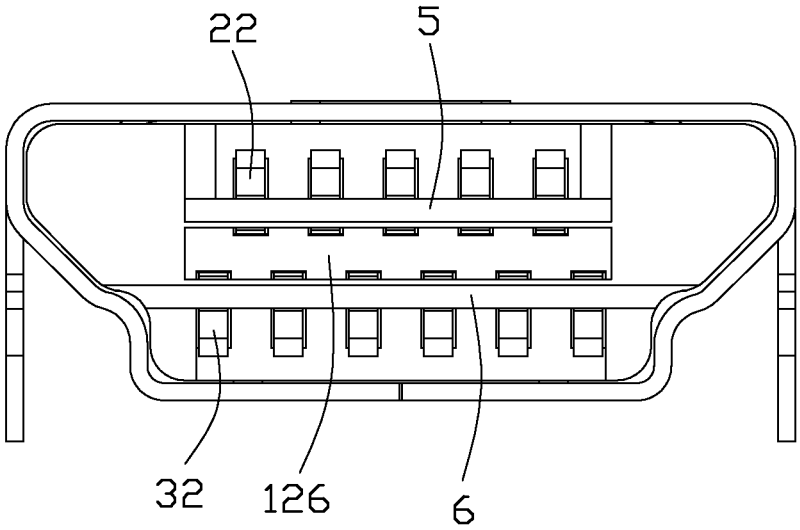
FIG. 6 is a front elevational view of the electrical connector shown in FIG. 1.

Referring to FIG. 6, the first contacting portions 22 are offset with the second contacting portions 32 in a front elevational view. Each first contacting portion 22 is located between two adjacent second contacting portions 32, and the receiving room 126 is disposed between the first and second contacting portions 22, 32 for receiving the deformed first and second contacting portions 22, 32. The receiving room 126 synchronously communicates with the first and second terminal receiving grooves 124, 125 in order to reduce the height of the mating tongue 12 to suite for miniaturization; furthermore, the contact pitch can be selectively set due to the receiving room 126. The receiving room 126 divides the mating tongue into first and second mating walls 5, 6 at a front end thereof, the first and second mating walls 5, 6 opposite to and spaced from each other in the vertical direction, the first mating wall 5 permits the resilient first contacting portions 22 passing therethrough while being deformed, and the second mating wall 6 permits the resilient second contacting portions 33 passing therethrough while being deformed.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing having a mating tongue extending in a front-to-back direction and defining opposite first and second mating faces opposite to each other in a vertical direction perpendicular to the front-to-back direction;

a plurality of first contacts retained in the housing and arranged in a transverse direction perpendicular to both the front-to-back direction and the vertical direction, the plurality of first contacts each defining a resilient first contacting portion exposed on the first mating face in the vertical direction and a first soldering portion extending out of the housing; and a plurality of second contacts retained in the housing and arranged in the transverse direction, the plurality of second contacts each defining a resilient second contacting portion exposed on the second mating face in the vertical direction and a second soldering portion extending out of the housing, the first contacting portions offset with the second contacting portions in a front elevational view;

wherein the mating tongue defines a receiving room at a front portion thereof between the said first mating face and said second mating face in the vertical direction and extending in the transverse direction, the receiving room runs through the first mating face to directly face to the first contacting portions in the vertical direction and synchronously runs through the second mating face to directly face to the second contacting portions in the vertical direction.

2. The electrical connector as described in claim 1, wherein the housing defines a plurality first receiving grooves arranged in the first mating face for receiving the plurality of first contact and a plurality of second receiving grooves arranged in the second mating face for receiving the plurality of second contact, the receiving room communicates with a front portion of the first receiving grooves for receiving the first contacting portions and communicates with a front portion of the second receiving grooves for receiving the second contacting portions.

3. The electrical connector as described in claim 1, wherein the receiving room forwardly runs through a front face of the mating tongue.

4. The electrical connector as described in claim 1, wherein the mating tongue provides a pair of strengthen arms integrally defined at two transverse ends thereof, the housing provides a recess portion between the two strengthen arms, an upper face of the mating tongue that disposed in the recess portion is provided as the first mating face, and a bottom face of the mating tongue is defined as the second mating face.

5. The electrical connector as described in claim 4, wherein each strengthen arm provides a first blocking portion projecting in the recess portion and a second blocking portion projecting from the second mating face, a first insertion depth is provided between the first blocking portion and a front face of the mating tongue, and a second insertion depth different from the first insertion depth is provided between the second blocking portion and the front face of the mating tongue.

6. The electrical connector as described in claim 1, wherein the first and second soldering portions are alternately arranged in one row along the transverse direction.

7. The electrical connector as described in claim 1, further comprising a metal shell shielding the housing, the mating tongue is disposed in a mating cavity defined by the metal shell.

8. An electrical connector comprising:

an insulative housing having a mating tongue forwardly extending along a front-to-back direction and opposite first and second mating faces in the vertical direction perpendicular to said front-to-back direction;

a plurality of first contacts arranged in a transverse direction perpendicular to the front-to-back direction and said vertical direction, and each defining a resilient first contacting portion exposed upon said first mating face of the mating tongue in the vertical direction; and a plurality of second contacts arranged in the transverse direction and each defining a resilient second contacting portion exposed upon said second mating face of the mating tongue in the vertical direction, the first contacting portions offset with the second contacting portions in a front view;

wherein the mating tongue provides first and second mating walls at a front end thereof between said first mating face and said second mating face and opposite to and spaced from each other in said vertical direction, the first mating wall permits the resilient first contacting portions passing therethrough while being deformed in the vertical direction, and the second mating wall permits the resilient second contacting portions passing therethrough while being deformed in the vertical direction; wherein a unified receiving room is provided between the first and second mating walls, and the resilient first and second contacting portions can be oppositely deformed to enter into the receiving room simultaneously.

9. The electrical connector as described in claim 8, wherein the mating tongue provides a pair of strengthen arms disposed at two transverse ends thereof, the first and second mating walls each connect with the pair of strengthen arms at two transverse ends thereof, and the receiving room is surrounded by the first mating wall, the second mating wall and the pair of strengthen arms.

10. The electrical connector as described in claim 8, wherein each first contact defines a first soldering portion extending out of the housing, and each second contact defines a second soldering portion extending out of the housing, the first and second soldering portions are alternately arranged in one row along the transverse direction.

11. The electrical connector as described in claim 8, further comprising a metal shell shielding the housing, the mating tongue is disposed in a mating cavity defined by the metal shell.

12. An electrical connector comprising:

an insulative housing defining a tongue with opposite upper and lower surfaces thereof in a vertical direction;

an upper mating cavity located above the upper surface;

a lower mating cavity locate below the lower surface;

a plurality of upper contacts disposed in an upper portion of the mating tongue with resilient contacting sections extending upwardly above the upper surface and into the upper mating cavity;

a plurality of lower contacts disposed in the lower portion of the mating tongue with resilient contacting sections extending downwardly below the lower surface and into the lower mating cavity; wherein said upper contacts and said lower contacts are alternately arranged with each other along a transverse direction, which is perpendicular to said vertical direction, with a space therebetween so as to allow inward deflection of the resilient contacting sections of said upper contacts and said lower contacts without mechanical interference when said upper contacts and said lower contacts are connected by complementary parts in the corresponding upper and lower mating cavities; wherein a single receiving room is formed between the upper surface and the lower surface to extend along said transverse direction and directly communicate with the corresponding upper contacts and the corresponding lower contacts in the vertical direction so as to allow said upper contacts to move downwardly and allow said lower contacts to move upwardly simultaneously in the vertical direction.

13. The electrical connector as claimed in claim 12, wherein said upper contacts and said lower contacts are not both inwardly deflected simultaneously.

* * * * *